United States Patent [19]

Hakansson

[11] Patent Number: 4,584,819

[45] Date of Patent: Apr. 29, 1986

[54] ARRANGEMENT FOR THE APPLICATION OF OBJECTS TO PACKING CONTAINERS

[75] Inventor: Jan Hakansson, Eslöv, Sweden

[73] Assignee: Tetra Pak International AB, Lund, Sweden

[21] Appl. No.: 619,982

[22] Filed: Jun. 12, 1984

[30] Foreign Application Priority Data

Jun. 23, 1983 [SE] Sweden ..... 8303620

[51] Int. Cl.[4] ..... B65B 19/34

[52] U.S. Cl. ..... 53/410; 53/128; 53/520

[58] Field of Search ..... 53/410, 520, 128, 133, 53/137, 580; 493/379, 380; 156/521

[56] References Cited

U.S. PATENT DOCUMENTS

| | | | |
|---|---|---|---|
| 3,376,687 | 4/1968 | Gewecke | 53/410 |
| 3,440,116 | 4/1969 | Whitecar | 156/70 |
| 4,121,401 | 10/1978 | Duerr et al. | 53/580 X |
| 4,233,331 | 11/1980 | Lemke et al. | 156/521 X |
| 4,293,369 | 10/1981 | Dilot et al. | 156/521 |
| 4,384,915 | 5/1983 | Utsumi | 493/379 X |

*Primary Examiner*—James F. Coan

*Attorney, Agent, or Firm*—Burns, Doane, Swecker & Mathis

[57] ABSTRACT

The disclosure relates to an apparatus for applying objects such as spoons or suction tubes diagonally to a side wall of a packing container. As the containers are advanced by a conveyor, a carriage reciprocates adjacent the conveyor. A rotary drum is mounted on an inclined axle on the carriage. The objects are supplied to the drum in the form of a band in which the objects are spaced apart. The drum holds the individual objects while they are severed from the band by a reciprocating knife. Rotation of drum positions each object in a correct angular position with respect to the side wall of the container. An adhesive applicator is also positioned on the carriage to apply adhesive to the side wall of the container. A transfer arm applies the object against the side wall of the container where it is retained by the adhesive.

9 Claims, 4 Drawing Figures

ARRANGEMENT FOR THE APPLICATION OF OBJECTS TO PACKING CONTAINERS

BACKGROUND AND SUMMARY OF THE INVENTION

The present invention relates to packaging machines, and more particularly to apparatus for affixing articles to the exterior of packages.

Foodstuffs of different types, e.g. fruit juices, fruit yoghurts or ice-creams are packaged frequently at present in nonreturnable packages of portion size. The contents of the packages are accessible via a suction tube hole or via an openable lid and are intended to be emptied with the help of a suction tube or a spoon. For reasons of hygiene, the suction tubes or spoons are generally wrapped in a protective sleeve and applied to the outside of the packages by means of tape or some other adhesive.

The attachment of each individually wrapped object of the suction tube or spoon type to the wall surface of the packing container may take place mechanically if the objects and the protective sleeves surrounding the objects are mutually connected to one another in such a manner that a coherent band is produced. The individually wrapped objects are separated from this band only in conjunction with the application to the individual packing containers.

It is generally desirable to provide a high-capacity machine for the application of suction tubes, spoons or other objects to prefabricated packing containers. It is assumed in this that the objects are wrapped in protective sleeves and are adapted to be fed to the machine in the form of a coherent band, that is to say the individual objects are placed transversely between carrier bands which are sealed to each other around the suction tubes so that together they form a coherent line of closed protective sleeves.

A machine for the application of suction tubes to prefabricated substantially parallelepipedic packing containers is known and described in Swedish Pat. No. 7801067-5. This machine has a rotatable driving element for the suction tubes wrapped in the protective sleeve and a path of advance for the packing containers. The packing containers are oriented in relation to the suction tubes before application with the help of packing container carrier means which are joined to an endless chain and arranged to be swivelled around an axis extending transversely in relation to the path so as to make possible an application of suction tubes diagonally over one side wall of the packing containers. The machine operates intermittently which, together with the relatively cumbersome orienting procedure means that the machine cannot be run at a speed which would allow it to readily be used together with modern, high-capacity packing machines.

It is an object of the present invention to provide an arrangement for the application of objects, and in particular suction tubes or spoons wrapped in protective sleeves, to packing containers, this arrangement not being subject to the disadvantages of earlier machines having complicated arrangements for the handling and orienting of the packing containers and the intermittent method of operation associated therewith.

It is a further object of the present invention to provide an arrangement for the application of objects to packing containers, this arrangement being capable of operating continuously and at an appreciably higher speed than previously known machines of a similar type.

These and other objects have been achieved in accordance with the invention by supporting the object to be attached to the packing container on a carriage that moves synchronously with the conveyor on which the containers are supported. The carriage is movable along a part of the conveyor and is adapted to perform a working stroke synchronously with the movement of the conveyor.

By placing the means which advances and transfers the object to the individual packing containers on a reciprocally movable carriage, the transfer of the objects can take place without the feed motion of the packing containers having to be interrupted, thereby ensuring an appreciably increased working speed compared with previously known, similar machines. Moreover, because of the oblique setting, of the driving means handling the objects and the path of advance of the objects in relation to the packing containers passing through the arrangement, a time-consuming separate orienting of each individual packing container prior to the transfer of the object to the container is avoided. This results in a greatly simplified construction and an increased working speed.

BRIEF DESCRIPTION OF THE DRAWINGS

A preferred embodiment of the machine in accordance with the invention is illustrated in the accompanying drawings, in which.

DETAILED DESCRIPTION OF THE PREFERRED EMBODIMENT

Figure 1:
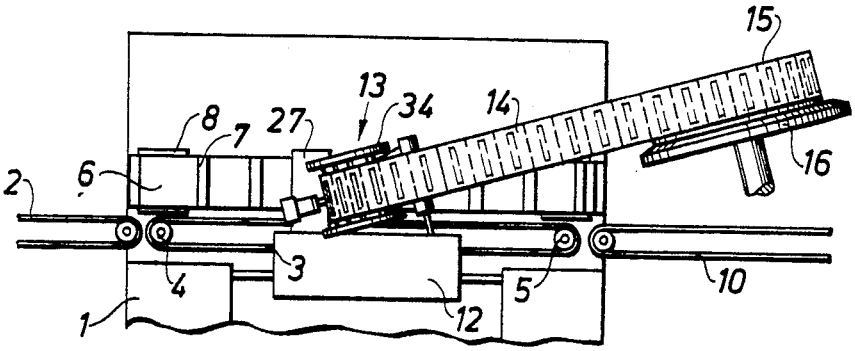
FIG. 1 is a side view of a part of the arrangement in accordance with the invention.
Figure 2:
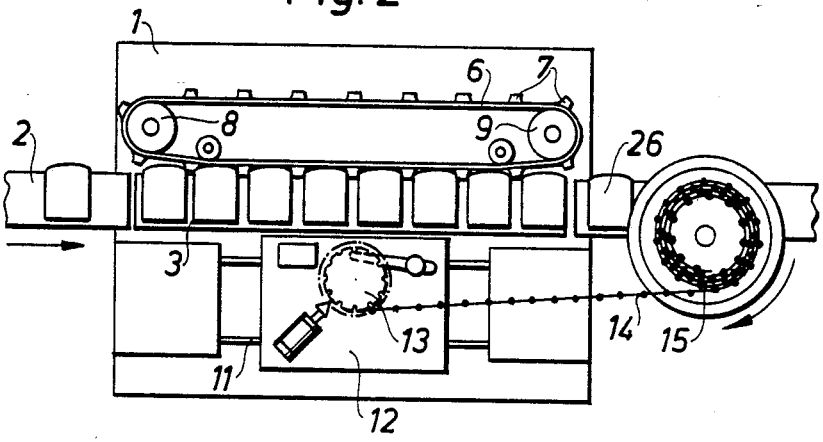
FIG. 2 is a top plan view of the arrangement in accordance with the invention during operation.

The arrangement or the machine in accordance with the invention comprises a stand 1, only a part of which is shown in the figures. The stand 1 supports the different machine components and comprises driving means in the form of electric motors, means of power transmission, gears etc. and various electric monitoring devices, guiding devices and other components which, however, are all of a conventional type and well known to those versed in the art. Accordingly, these known components are not described in detail in the present context.

The arrangement in accordance with the invention (hereinafter called "applicator") is intended to be used together with a packaging machine of the type which forms filled packing containers from material in the form of a web or sheets. The applicator is placed so that the finished packing containers fed out from the packing machine are passed to it by means of a conveyer belt 2. When the packing containers have reached the applicator they are transferred to a horizontal conveyer 3 which is in the shape of an endless belt extending between two end pulleys, 4, 5 supported horizontally in the machine stand. An endless feed chain 6 extends parallel with respect to the conveyor 3 and runs around two end pulleys 8 and 9 supported vertically in the stand of the arrangement. The feed chain 6 is oriented so that its active part runs along one lateral edge of the conveyor 3, with drivers 7 of the feed chain 6 extending slightly over the upper, active part of the conveyor. The drivers 7 are designed so as to have a profile which corresponds to the profile of the particular type of packing container which is to be provided with suction tubes or spoons. In order to accommodate other types of packages or sizes of packages, the drivers 7 are exchangeable in a simple manner. Extending from an end of the conveyor 3 is a second conveyor belt 10 which carries the finished packing containers provided with suction tubes for further transport to a packaging plant of a known type.

Positioned at the side of the conveyor 3 opposite the feed chain 6 are guides 11 extending parallel to the conveyor, along which a carriage 12 is movable to and fro in working and return strokes, respectively. The carriage 12 is driven by means of a cam and a lever system which, however, are conventional and are not shown, therefore, in the figures. On the upper side of the carriage a rotatable driving element 13 is provided for the advancing and orienting of suction tubes. The driving means comprise a central axle 29 which can be rotated by means of a motor (not shown). The axle 29 carries two parallel parts or wheels arranged at a little distance above each which are provided with evenly spaced peripheral recesses 23 to accommodate suction tubes. The suction tubes are fed in the form of a suction tube band 14 which is in the form of a roll 15 positioned on a roll holder 16.

Provided on the carriage 12, beside the rotatable driving means 13, is a cutting means 17 which comprises a knife 19 movable reciprocally by means of a piston and cylinder unit 18. The knife 19 cooperates with a hold-on element 20 which is fixed on the carriage 12 and extends between wheels of the driving means (see in particular FIG. 3 where the upper part of the driving means 13 has been removed to illustrate this more clearly). The hold-on element 20 comprises a recess 21 adapted to cooperate with the knife 19, this recess being located at a short distance inside the periphery of the driving means 13. Privided along the periphery of the driving means 13 is a guide rail 22 which extends around substantially half the circumference of the driving means 13 a short distance from the individual wheels forming the driving means. The distance between the guide rail 22 and the driving means has been chosen so that suction tubes provided with sleeves introduced into the recesses 23 are retained in the recesses without any risk of jamming or other damage arising. The suction tubes are guided in an axial direction with the assistance of two dished plates or guiding means 34 which are mounted on the axle 29 above and below, respectively, the wheels of the driving means 13 and rotate wtih the wheels.

Figure 3:
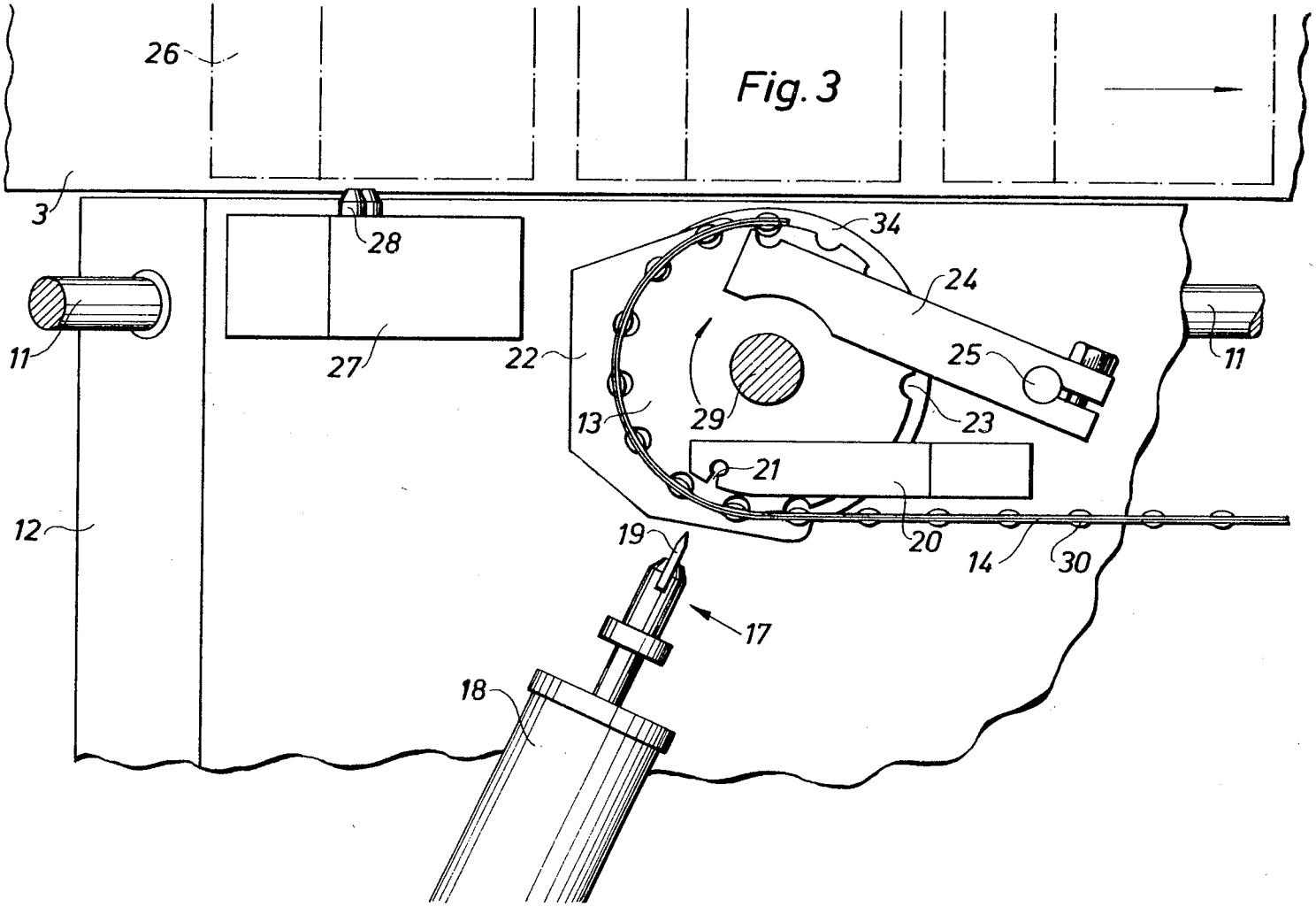
FIG. 3 is an enlarged sectional view of a part of the invention depicted in FIG. 2.

Located at one end of the guide rail 22 is a transfer means 24 consisting of one or more identical arms which can be swivelled oscillate about an axle 25 supported so that it can rotate in the carriage 12. In FIG. 3, the transfer means is shown in the withdrawn or inactive position. The transfer means can be rotated by the axle 25 to an active position wherein its front end provided with a recess is substantially in contact with a packing container 26 advanced by means of the conveyor 3.

On the upper side of the carriage 12 there is also an adhesive applicator 27 which is placed in front of the driving means 13 with respect to the direction of movement of the packing containers 26. The adhesive applicator 27 is provided with nozzles 28 which are oriented so that on activation of the applicator they place a predetermined quantity of adhesive (preferably so-called hotmelt) in the correct position onto a side of the passing packing container 26 for which a suction tube is to be provided.

The driving means 23 as well as the devices 17, 24 cooperating therewith are adapted so that the suction tubes which are to be transferred to the packing container assume the correct angular position thereon. It is frequently desirable in the case of parallelepipedic packing containers or packing containers which have a four-sided side wall that the suction tube be placed diagonally between two opposite corners on the side wall, since this makes it possible to maximize the length of the suction tube without the same projecting with any of its parts outside the contour of the packing container. For this reason, the driving means 13 is placed in such a manner that its axle of rotation 29 is at the same angle of inclination in relation to the conveyer 3 as the angle of inclination which the suction tubes should be at when they have been applied to the lateral surfaces of the packing containers. To facilitate the feed of the suction tube band 14 to the driving means 13, the roll folder 16 is oriented so that the suction tube band 14 can be advanced along a path which is at the corresponding angle of inclination in relation to the conveyer 3. The roll holder 16 is supported so that it can rotate in a projecting, fixed part of the machine stand, but it is also possible to place the roll holder directly onto the carriage 12, which results in a smoother transfer of the suction tube band from the roll 15 to the driving means 13 but limits the sizes of the rolls which may be used.

Figure 4:
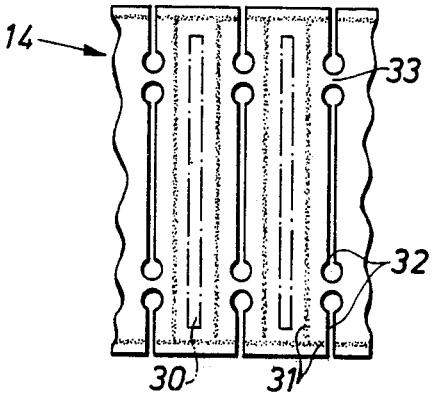
FIG. 4 is a top plan view of a suction tube band.

A part of a suction tube band 14 for use with the machine in accordance with the invention is shown in FIG. 4. The suction tube band is of conventional design and comprises two elongated plastic strips between which a number of suction tubes 30 are placed at equal intervals. The suction tubes 30 are situated transversely in relation to the suction tube band 14 and the plastic strips are joined to each other by means of seals 31 which together form closed spaces for the suction tubes 30. Between these spaces the suction tube band 14 is provided with slits 32 some of which extend from the two lateral edges of the suction tube band 14 and inwards. Other slits 32 extend over a central portion of the suction tube band 14 (in line with the slits extending from the lateral edges of the band). All of the slits 32 are terminated by round holes which serve as channels and prevent undesirable splitting open of the suction tube band 14. Between the ends of the slits 32 coherent areas or bridges 33 are provided which connect the suction tube packages, which are delimited by means of the slits 32 to one another. When the individually wrapped suction tubes 30 are to be severed from the suction tube band 14, these bridges 33 are cut through with the help of the knife 19, which for this purpose is provided with two knife edges situated at an appropriate distance from each other.

During operation of the suction tube applicator, packing containers are fed from a packaging and filling machine by means of the conveyor belt 2 whose rear end directly adjoins the front end of the conveyor 3. The packing containers are transferred to the conveyor 3 which, together with the feed chain 6, feeds the packing containers from left to right, as shown in the figures. The feed chain 6 and the conveyor 3 are driven synchronously and the distance between the drivers 7 and the shape of the drivers is chosen so that the packing containers are transported through the machine in a secure and accurate manner which is necessary in order to ensure a correct synchronization between the feed position of each individual packing container and the reciprocating carriage 12. The carriage 12 is moved continuously in a reciprocating manner in working and return strokes between two turning positions, the carriage moving during the working stroke at the same speed as the packing containers are advanced on the conveyor. The working stroke of the carriage 12, moreover, is so adapted to the movement of the continuously advanced packing containers that the part of the driving means 13 by which the transfer means 24 transfers a suction tube to a packing container is oriented directly in front of the location on the side wall of the packing container where the suction tube is to be attached. The adhesive applicator 27 also present on the carriage 12 is at such a distance from the driving means 13 that the distance between the nozzle 28 of the adhesive applicator 27 and the active part of the transfer means 24 coincides with the spacing between two adjacent packing containers 26.

Hence during the working stroke of the carriage 12 adhesive is applied to a packing container at the same time as a suction tube is transferred to the adjoining packing container which, during the earlier working stroke of the carriage 12, had been provided with adhesive. The transfer of the adhesive, which usually consists of hotmelt glue, takes place with the help of the adhesive applicator 27 which, via the nozzle 28 with a certain pressure, applies a predetermined quantity of hotmelt adhesive to the lateral surface of the packing container. Since it is desirable, as mentioned earlier, to place the suction tube diagonally over the side wall of the packing container so as to make possible a maximum length of suction tube, the adhesive is applied at two diagonally opposite corners of the side wall of the packing container. The desirable diagonal application of the suction tube to the packing containers is ensured, as mentioned previously, by inclining the axle of rotation 29 of the driving means 13 in relation to the path of movement of the carriage 12. The angle of inclination here coincides with the angle of inclination intended for a suction tube applied to the finished package. As shown, for example, in FIG. 1, it is not only the driving means which is inclined, but also the cutting means 17 and the transfer means 24 cooperating with the driving means. The suction tube band 14 and the roll holder 16 for the roll 15 of the suction tube band are also at a corresponding angle of inclination so as to facilitate the feed of suction tubes to the driving means 13.

After the application of hotmelt adhesive to a side wall of a packing container 26, the carriage 12 performs a return stroke which occurs at relatively high speed, whereupon a subsequent working stroke is started. When this happens the packing containers 26 are advanced such a distance in relation to the carriage 12 that the packing container provided previously with hotmelt adhesive is now directly in front of the driving means 13 and is ready for transfer and application of a suction tube.

During the first part of the working stroke of the carriage 12 the driving means 13 is rotated one step, over an angle which corresponds to the spacing between adjacent recesses 23 for suction tubes arranged along the driving means 13. As a consequence of this rotation of the driving means 13, the suction tube band 14 is advanced a corresponding distance so that a new suction tube 30 arrives at a recess 23 directly adjoining the front end of the guide rail 22. Rotation of the driving means 13 by one step in a clockwise direction means also that a suction tube fed previously into the driving means is moved to a tube transfer position which is located at a rear end of the guide rail 22. This position is reached when the suction tube is between an active end of the transfer means 24 and an adjoining packing container advanced on the conveyor synchronously with the carriage, which packing container during the preceding working stroke of the carriage has been provided with hotmelt. While the hotmelt is still warm and sticky, a transfer of the suction tube takes place, as the transfer means 24 performs a short clockwise rotation so that its active end which is provided with a recess rapidly transfers the suction tube to the container wall where it adheres in the sticky adhesive. Due to the angle of inclination of the driving means 13 and the axle 25, the suction tube will be applied to the side of the packing container in a corresponding angle, ending up diagonally between two corresponding corners. After the transfer of a suction tube to a packing container, the carriage 12, having completed its working stroke, is returned at a relatively high speed to its corresponding end position, depicted at the left-hand position in the figures. During the return stroke of the carriage 12, the piston and cylinder unit 18 is activated so that the knife means 19 is brought into contact with, and cuts through, the bridges 33 which connect the individual suction tube packages in the suction tube band 14. The cutting is done by means of cooperation between the knife means 19 and the recess 21 in the hold-on 20 which, like the transfer means 24, extends inside the circumference of the driving means 13. The suction tubes and associated suction tube sleeves which have been separated from one another retain their correct position in the recesses 23 of the driving means 13 in spite of the cutting process, since they are retained in a radial orientation by the guide rail 22 and are prevented from sliding in an axial direction by a dished guiding means 34 situated at an upper and lower part of the driving means 13. After the carriage has reached its end position, a new working stroke is started during which the procedure is repeated, that is to say adhesive is applied to a packing container at the same time as the packing container located in front of this container is provided with a suction tube. By ensuring that the rotation of the driving means 13 and hence the advance of the suction tube band 14 take place during the working stroke of the carriage 12, the stresses are considerably reduced which would otherwise arise in the suction tube band during the stepped advance of the suction tube band, since the driving means 13 rotates at the same time as the roll 15 approaches. Accordingly, uncoiling of the suction tube band from the roll 15 does not take place during the rotation of the driving means 13. Rather, that rotation takes up the surplus of suction tube band which arises owing to the movement of the carriage from left to the right in the figures. The suction tube band 14 instead is uncoiled from the roll 15 during the return stroke of the carriage which consequently can take place relatively smoothly and without jerks with even acceleration and retardation.

What is claimed is:

1. Apparatus for the individual application of elongated objects to packing containers, said apparatus comprising a conveyor for advancing the packing containers, driving means for advancing said objects to a predetermined position for transfer to the packing containers, said driving means being supported by a carriage movable along a portion of the conveyor to perform a working stroke synchronously with movement of the conveyor wherein said driving means cooperates with a cutting means and a transfer means so that said objects are applied to said packing containers in a predetermined angular position with respect to said packing container, said driving means, said cutting means and said transfer means being inclined relative to the path of feed of said packing containers, said objects advanced to said driving means along a path extending at the same angle of inclination as the feed path of said packing containers.

2. The apparatus in accordance with claim 1, wherein the driving means is rotatably supported in the carriage and includes a plurality of peripheral recesses for receiving said objects and a guide rail extending along a part of the periphery of the driving means so as to retain the objects in the recesses.

3. The arrangement in accordance with claim 1, wherein said cutting means positioned on said carriage cooperates with said driving means for separating said objects.

4. The apparatus in accordance with claim 3, wherein said cutting means comprises a knife adjacent said driving means and a fixed element extending into a recess in said driving means so that an active part of said element extends between said knife and a center axle of said driving means.

5. The apparatus in accordance with claim 2, wherein said transfer means extends into one of said peripheral recesses in said driving means and is maneuverable between a first position wherein an active part of said transfer means is located between a central axis of the driving means and an object advanced to a selected position for transfer to a packing container and a second position wherein the transfer means applies said coherent object against a wall surface of the packing container.

6. The apparatus in accordance with claim 2, wherein said driving means is rotated in steps, each step occurring when said carriage performs a working stroke.

7. The apparatus in accordance with claim 6, wherein said advance of said packing containers during application of said objects to said packing containers is guided by a feed chain provided with drivers.

8. The apparatus in accordance with claim 3 wherein said objects are supplied to said driving means in a continuous band, said driving means advancing said objects from a second predetermined position to said first mentioned position, said cutting means being located adjacent said driving means for severing individual objects from said band at said second position, and means on said carriage for applying adhesive to the packing containers for subsequent application of said objects to the containers.

9. A method of applying an elongated object diagonally to a side wall of a packing container in a continuous operation including the steps of:

(a) advancing a plurality of packing containers on a conveyor at uniform spaced intervals along a straight feed path;

(b) advancing a band of elongated objects, said objects having their greater dimensions extending transversely of the direction of advance of said band;

(c) severing said objects individually from said band while holding said objects diagonally relative to the side wall of the containers;

(d) advancing said objects to a position adjacent to containers on the conveyor;

(e) applying adhesive to the side wall of the container; and (f) transferring said one of said objects from a position adjacent the container to the side wall of the container in a predetermined angular position while said container advances along said conveyor wherein the advancing of the packing container, the severing of the objects and the transferring of said one of the objects is along a path inclined relative to said feed path.

* * * * *